US007036957B2

(12) United States Patent
Paravantsos

(10) Patent No.: US 7,036,957 B2
(45) Date of Patent: May 2, 2006

(54) SYSTEMS OF PARABOLIC REFLECTORS AND BASE OF A LUMINAIRE WITH FLUORESCENT LAMPS

(75) Inventor: Antonios Paravantsos, Salonika (GR)

(73) Assignee: Pilux & Danpex A.G., Thessaloniki (GR)

( * ) Notice: Subject to any disclaimer, the term of this patent is extended or adjusted under 35 U.S.C. 154(b) by 0 days.

(21) Appl. No.: 10/148,794

(22) PCT Filed: Oct. 1, 2001

(86) PCT No.: PCT/GR01/00037

§ 371 (c)(1),
(2), (4) Date: Jun. 4, 2002

(87) PCT Pub. No.: WO02/35147

PCT Pub. Date: May 2, 2002

(65) Prior Publication Data

US 2003/0002285 A1 Jan. 2, 2003

(30) Foreign Application Priority Data

Oct. 26, 2000 (GR) ..... 20000100372

(51) Int. Cl.
*F21V 11/02* (2006.01)

(52) U.S. Cl. ..... 362/247; 362/217; 362/221; 362/224; 362/290; 362/342; 362/292; 362/291

(58) Field of Classification Search ..... 362/217, 362/221, 222, 224, 225, 290, 342, 291, 292
See application file for complete search history.

(56) References Cited

U.S. PATENT DOCUMENTS 2,971,083 A * 2/1961 Phillips et al. ..... 362/342
3,089,023 A 5/1963 Trott
4,059,754 A * 11/1977 Lewin ..... 362/217

(Continued)

FOREIGN PATENT DOCUMENTS

FR 1534367 A 7/1968

OTHER PUBLICATIONS

PCT International Search Report for corresponding Appl. No. PCT/GR01/0037, discussing cites 1-4 hereinabove.

*Primary Examiner*—Sandra O'Shea
*Assistant Examiner*—Anabel Ton
(74) *Attorney, Agent, or Firm*—Charles E. Bruzga; Bruzga & Associates

(57) ABSTRACT

System of reflectors and base of parabolic fluorescent luminary for concentrating and guiding light, with improved light output and reduction in construction cost. On the support base of the electrical components of the luminary, two of the four side walls are made of plastic, which are assembled by easy and quick snapping to the main body of iron sheet. These plastic side walls have specific cavities and projections for mounting a grid of parabolic reflectors, which consists of the following, two separate parts made of thin plastic film of at least one reflecting surface: (i) the main parabolic components for directing the light, which are placed under fluorescent lamps, and (ii) the upper cross-made grid, which can be removed from the luminary independently of the main parabolic components. Thus, the main parabolic components do not need to have openings along the lamps. As a result, their continuous parabolic shape improves significantly the light output of the parabolic luminary.

10 Claims, 5 Drawing Sheets

U.S. PATENT DOCUMENTS 5,207,504 A 5/1993 Swift et al.
5,806,972 A * 9/1998 Kaiser et al. ..... 362/290
5,884,993 A * 3/1999 Conn ..... 362/217
6,092,913 A 7/2000 Edwards, Jr.
6,210,019 B1 * 4/2001 Weathers ..... 362/220
6,210,025 B1 * 4/2001 Schmidt et al. ..... 362/362
6,273,592 B1 * 8/2001 Herst et al. ..... 362/342
6,536,919 B1 * 3/2003 Johnson et al. ..... 362/265
6,582,098 B1 * 6/2003 Brown et al. ..... 362/291
6,764,199 B1 * 7/2004 Hess ..... 362/290

* cited by examiner

SYSTEMS OF PARABOLIC REFLECTORS AND BASE OF A LUMINAIRE WITH FLUORESCENT LAMPS

FIELD OF THE INVENTION

The present invention relates to a system of reflectors and base of parabolic fluorescent luminary having parabolic diffusive or catoptrical reflectors, which concentrate and focus the light. This kind of luminary comes in two versions: for recessed mounting into false or exposed ceilings, and for surface mounting on solid ceilings.

BACKGROUND OF THE INVENTION

The recessed luminaries with parabolic louvres, which one finds in the marketplace, are made of a metallic base on which all the necessary electrical components are placed, and a grid of parabolic reflectors—either diffusive or catoptrical—which concentrate and focus the light. This grid is placed into the metallic base of the luminary. The reflection grid, consisting of parabolic louvres, is made of individual elements of different shape, which are interconnected and thus compose a uniform cellular network. The parabolic louvres, which are deployed in the luminaries for false, and solid, ceilings and are presently in the international market, are mainly (90%) constructed of a thin aluminum sheet of at least one reflecting surface, either catoptrical or diffusive.

The support base for the electrical components of all the known models of fluorescent luminaries for false ceilings available today is completely made out of iron sheet, which, through proper cuttings and formations, reaches its final and desirable shape. The shape of the metallic base of the luminaries for false ceilings is a box-like housing of approximately 10-cm depth which is open on its upper side. The shape of this box, seen from an upper view, is either a perfect square or a rectangular parallelogram of minimum dimensions 10×60 cm and maximum dimensions 62×160 cm. The forming of the iron sheet into boxes of such dimensions, and especially the construction of the four sidewalls of the base, is achieved by many different shaping phases. This process increases considerably the production cost of the metallic support base for the electrical components and, consequently, the final price of the parabolic luminary for false ceilings. One of the shaping phases followed by most manufacturers that increases considerably the time and cost needed for construction of the base is the welding or the riveted jointing of the side walls of the base at the four side edges of the square or rectangular box so as to achieve steadiness and binding of the box. Furthermore, the sole use of iron sheet for the construction of the base results in making the end product quite weighty. Another consequence of this is the unnecessary weight to be carried by the false ceiling. It is also difficult to handle the product during its production process as well as for the electrician to install it due to its weight.

The grid of the parabolic reflectors of the fluorescent luminaries for, solid and false, ceilings is a net of elements of different shapes, which are mainly constructed of thin aluminum sheet, which has at least one catoptrical or diffusive surface. First of all, this grid consists of a square or a rectangular frame, which is formed by four linear elements joined together at the four corners. The main parabolic components, which are to reflect and focus the light, are proportional to the number of lamps of the luminary and are fixed in the two opposite sides and at the inner part of the frame. At the other two sides of the frame and vertically towards the main parabolic components, the elements of the parabolic or non-parabolic transverse blades are placed, thus making it possible to create a reflection grid. This grid, besides concentrating and focusing the light, is also useful in blocking the view of the fluorescent lamps of the installed luminary from an observer, who sees the luminary from a certain angle. The dimension of the angle from which the fluorescent lamps are not visible depends on the quality of the louvres and turns out to be one characteristic feature of recognition which distinguishes the parabolic fluorescent luminaries for exposed, and false, ceilings from any other and classifies them into different categories.

In all parabolic fluorescent luminaries for solid, and false, ceilings known until today, in order to replace the lamps or the starters, the louvre made of the cross blades described above has to be removed beforehand so as to gain access to the lamps and the starters. In order that the grid of the reflectors (louvre) could be removed without being blocked by the fluorescent lamps of the luminary, the transverse blades of the grid have openings along their entire length. This means that they are placed exactly underneath the fluorescent lamps so as to overcome the obstacle of the installed lamps upon the removal of the reflection grid. The fact that there is no parabolic reflective surface underneath the fluorescent lamps is the cause for part of the light output which is diffused from the lower part of the lamps being directed towards the flat surface of the metallic base of the luminary and not spread uniformly, therefore not being concentrated and focused properly towards the floor. This would not have been the case if there were a continuous parabolic reflector underneath the fluorescent lamps.

There are sections of the metallic base that are not covered by the reflection grid and these sections serve as light reflection surfaces. Since these sections are visible to the observer, the manufacturers have to paint the whole iron sheet base for the support of the electrical components in white color. This results in an even higher production cost of the luminary in question.

SUMMARY OF THE INVENTION

The described invention aims at eliminating the above disadvantages. For the construction of the main base for the electrical components of the parabolic fluorescent luminaries for false ceilings, plastic parts are used for the two more elaborated sides of the base. These two plastic sides are assembled to the main body of the iron sheet base by means of simple snapping and not by welding or riveted jointing on the main iron-sheet body of the base. Consequently, the main body of the metallic base is modulated, or provided with bends along the length of the fluorescent lamps, only in its two out-of-four side walls of the square or rectangular base of the luminary.

The fact that the main metallic body of the base has not been modulated when made in two of its four side walls allows it to be easily shaped with three oblong ribs placed at the bottom wall from the one free end to the other. These ribs reinforce the metallic body, enabling the reduction of the thickness of the iron sheet used for the construction of the base from 0.6 mm, which is the case with other manufacturers, to 0.4 mm. The flexible quality of the plastic material, from which the two sides of the base are made, facilitates their easy and firm snapping to the main metallic base. On the other hand, the snapping between two metallic pieces would cause some difficulties.

In addition to this, the plastic sidewalls of the base have specifically shaped cavities and projections, which make it possible for the grid of parabolic reflectors to be mounted directly on them without use of any other supplementary hardware.

The invention improves the light efficiency of the parabolic fluorescent luminary for solid, and false, ceilings by using a separable reflection grid instead of a unique one. This device allows the main parabolic elements concentrating and focusing the light to be completely independent from the upper part of the grid. In this way, the main parabolic elements are placed underneath the fluorescent lamps and have an ideal parabolic shape (curved) for maximizing light output. These parabolic elements do not leave openings underneath the lamps. If the lamps or the starters need to be replaced it is only the upper part of the reflection grid that has to be removed. In the lower part, which is independent, the main parabolic elements remain stable in their places without hindering the removal or placing of the fluorescent lamps or the starters of the luminary.

The components of this separable reflection grid are constructed by thermo-mechanical treatment of a special thin plastic film of at least one reflecting surface being either catoptrical or diffusive. This film is by 50% lighter compared to the thinnest aluminum that is used so far in the construction of light reflection grids to this type of luminary.

The special thin plastic film of at least one reflecting surface results from uniting a very thin membrane (approximately 0.015 mm) with surface of high reflective property on a thicker layer of a material with a thickness approximately 0.10–0.40 mm, such as PET, polypropylene, presspaper, PVC and others.

The reduction of thickness of the iron sheet used for the construction of the main body of the base for the electrical components, as well as the use of plastic raw material in two out of the four side walls, reduce considerably the total weight of the base of the luminary. This means a weight reduction of 20% up to 35% compared to the bases of other known types of similar luminaries for false ceilings. Thus, the total reduction of the weight of the luminary deriving from the base and the reflection grid, compared to competitive luminaries in the market, reaches 25% to 40%. A positive effect is the lesser loading of a false ceiling with excessive weight and the easier handling of the luminary during the production and the installation process.

The plastic material of the reflection grid eliminates the risk of cut injury to the installer because of sharp edges, as is the case with aluminum foil. Moreover, the flexibility of the plastic material makes it resistant to damage from mechanical pressure upon installation.

Another advantage is that, owing to its very low weight, the plastic reflection grid is harmless in case it accidentally falls down from the ceiling.

Finally, the elimination of the openings at the sections of the main parabolic components of the separable grid, which are situated exactly underneath the fluorescent lamps, allows the use of non-painted, galvanized iron sheet, since the iron sheet is completely covered by parabolic reflective surfaces. The use of galvanized iron sheet eliminates the additional cost for painting of the base of the luminary, and galvanized iron is more corrosion proof compared to a common black-colored iron sheet.

The benefits offered by this invention are first of all the reduction of the production cost of the supporting base for the electrical components of the parabolic, fluorescent luminaries for false ceilings. This is due to the use of plastic elements that compose the two more elaborated side walls out of the four side walls of the base. The independent plastic side walls are assembled in a very easy manner—i.e., snapped on—in the main body of the iron sheet base without the time-consuming procedure of welding or riveted jointing which otherwise would have had to be carried out to all four sides of the base, if all of these sides were made out of metal. The plastic side walls are shaped properly in order to mount directly the parabolic reflectors of the luminary without use of any other means.

In addition to this, the possibility to strengthen the base by means of special ribs located at the bottom section—owing to the use of the two additional plastic side walls—allows the reduction of the thickness of the iron sheet by 40% which, eventually, reduces the construction cost of the base (i.e., less material, less cost).

The second and most important benefit resulting from this invention is the improvement of the light efficiency of the luminaries for solid, and false, ceilings. This is achieved by the separable reflection grid, which allows the lower parabolic components, which reflect and direct the light, to be independent. In doing so, the upper part of the separable grid serves mainly as a discreet cover of the fluorescent lamps, from the viewpoint of a random observer viewing the luminary from a certain angle. Upon replacement of the lamps or the starters, it is necessary to remove only the upper part of the separable reflection grid. Therefore, it is not necessary during this process to remove the main parabolic components for light concentration and focus.

Thus, the main parabolic components are permanently placed underneath the fluorescent lamps and embrace, with their ideal (curved) parabolic shape, the complete lower part of the lamps without leaving any openings whatsoever, along the lower part of the luminaries. This contrasts with the case of competitive luminaries which allows the removal of the unified grid reflectors net only by surpassing the obstacle of the installed fluorescent luminaries. The fact that those openings do not exist in the body of the main parabolic components but, on the contrary, there is continuous reflecting surface underneath the fluorescent lamps, leads to the saving of the reflected light so that the light of the luminary is focused and concentrated appropriately towards the desirable direction.

A great reduction of the weight of the finally produced parabolic false ceiling luminary results from (i) reduction of the thin sheet's thickness, of which is made the main body of the base of the electrical components, (ii) the use of two plastic side walls in the base and (iii) the use of thin plastic film of at least one reflecting surface for the construction of the reflectors' net This leads to easier handling of the luminary during its production and its placement by the installer. Furthermore, the aggravation of false ceilings in which those luminaries are based can be avoided.

DETAILED DESCRIPTION OF THE INVENTION

The description of the drawings, which illustrate the invention's application, is as follows.

Figure 2:
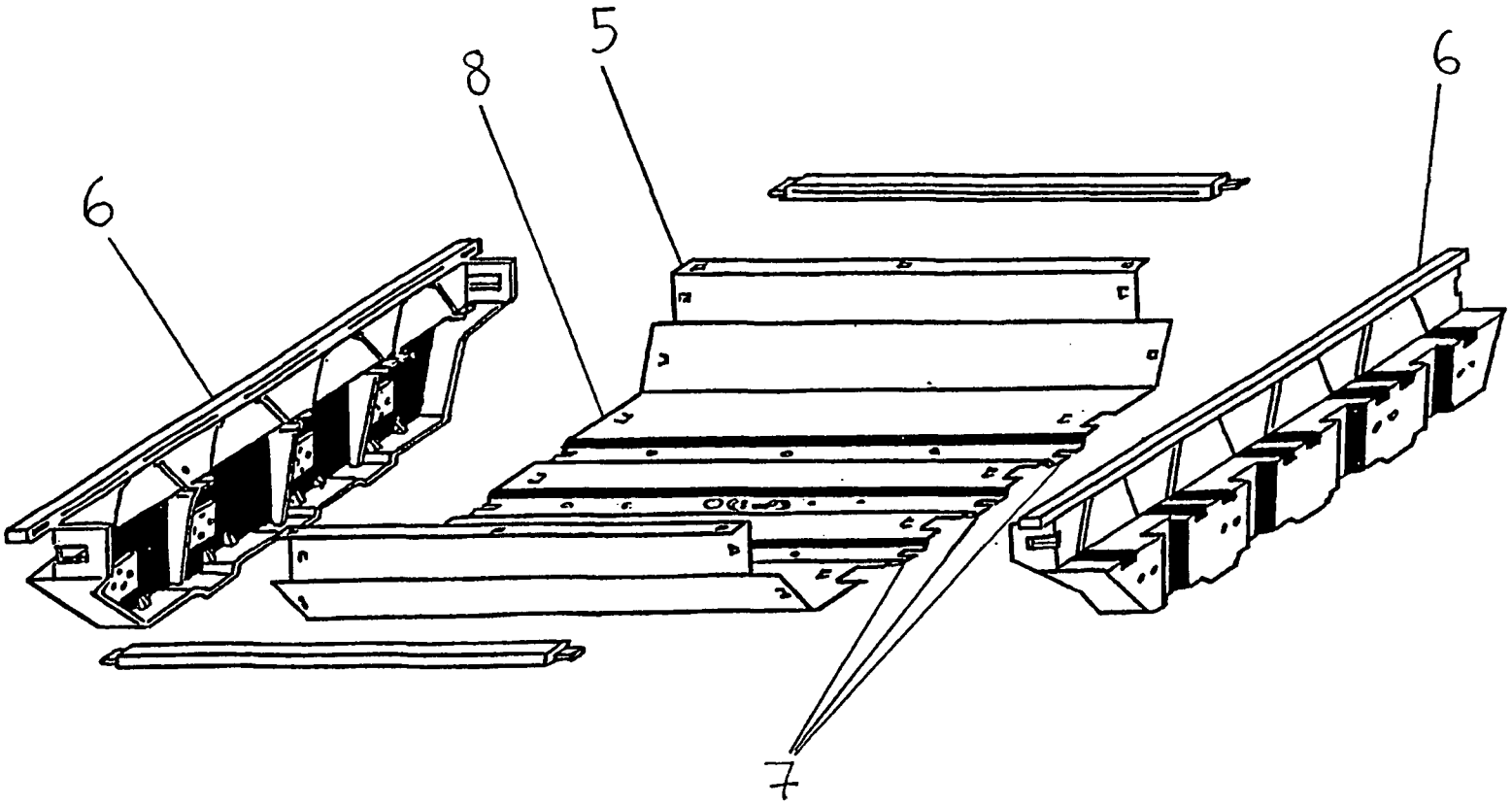
FIG. 2 is a perspective view of the electrical components' support base of the parabolic false ceiling luminary of the invention, shown in exploded form.

The parabolic fluorescent false ceiling luminary of the invention contains the support base (1) of the electrical components and a divided grid of reflectors (2, 3) for the concentration and focalization of the light emitted by the fluorescent lamps (4). The support base (1) of the electrical components consists of the main iron sheet body (5) (e.g, FIG. 2) and of two plastic side walls (6), which are assembled on the main body by sheet (5) by being snapped in an easy way without the time-consuming procedure of welding or riveted jointing that would be needed on the four corners of the box if all four sides of the base (1) were metallic.

Due to the use of plastic side walls (6) on the base (1), the main iron sheet body (5) of the base is initially free at both sides (8) without having pre-shaped the two of its four side walls. Thus, it is possible to rib (7) the bottom of the main base (1) body (5) with the appropriate shaping all along the main sheet body (5) from the one free end to the other. This mechanical support of the bottom of the main base body (5) allows the reduction by 40% of the thickness of the iron sheet, contributing to reducing the cost of the material. Furthermore, the construction of two base (1) side walls (6) of plastic raw material as well as the reduction of the iron sheet's thickness result in the reduction of the base's weight (1) by 20% up to 35% in relation to the respective competitive luminaries.

Figure 1:
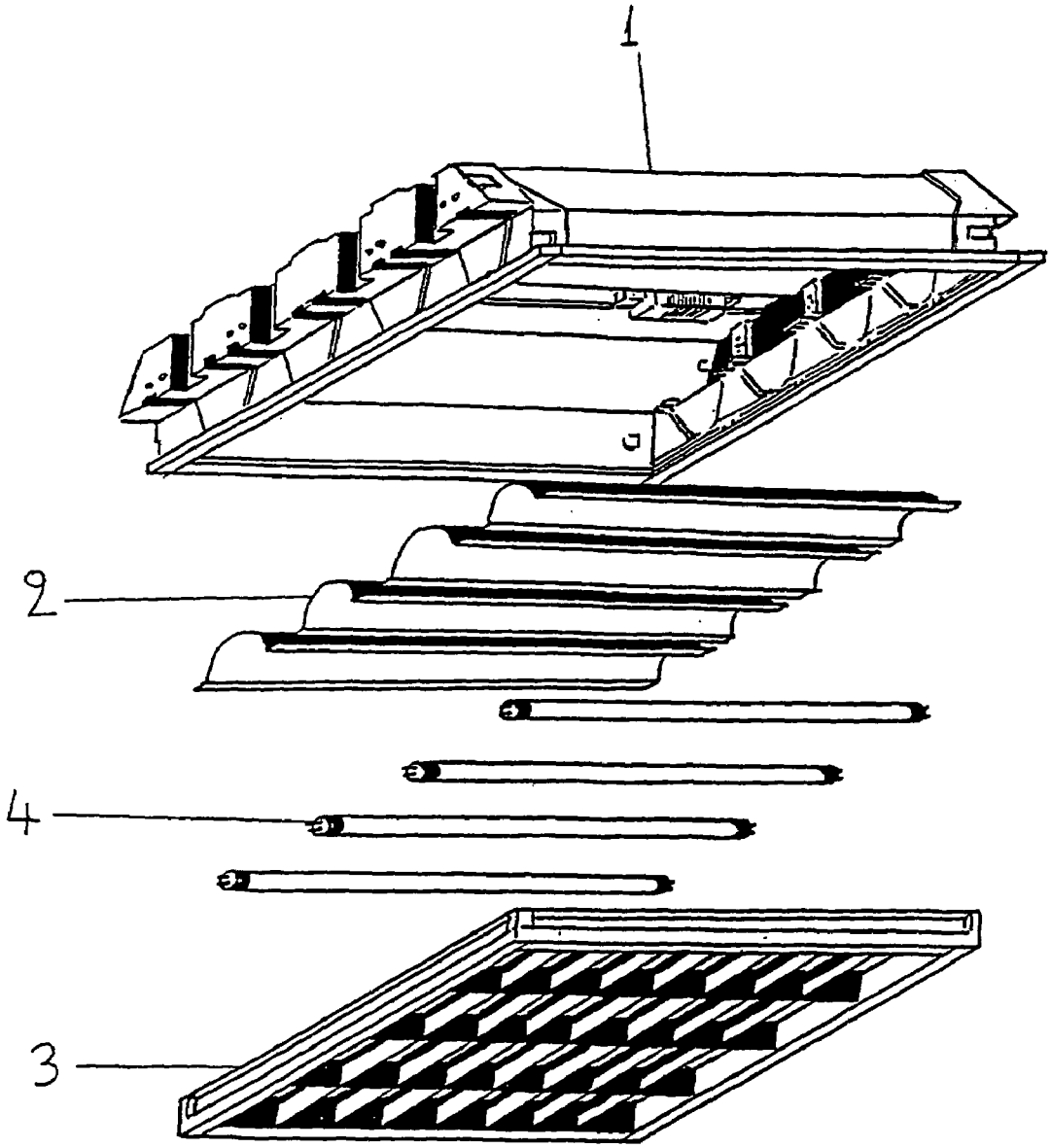
FIG. 1 is a perspective view of the parabolic false ceiling fluorescent luminary of the invention, shown in exploded form.
Figure 6:
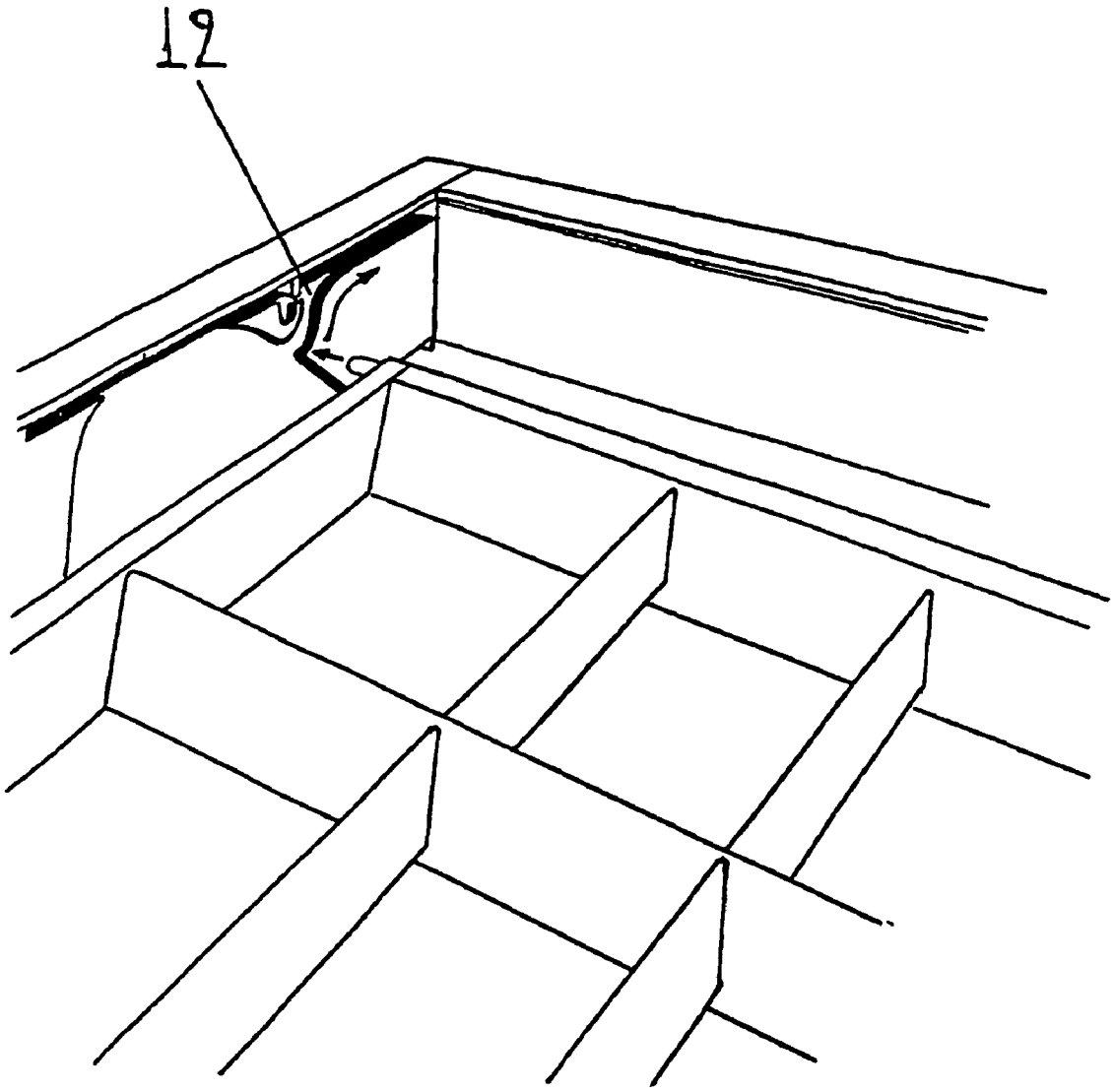
FIG. 6 is a partial view in perspective of the specific shaping of the plastic side walls for mounting the upper section of the separable grid of reflectors.

According to the present invention, the grid of parabolic reflectors (2, 3) (e.g., FIG. 1) is divided into two parts. The lower part consists of main parabolic light reflection and direction components (2) which are supported on the two plastic side walls (6) of the base (1) by means of specific cavities and projections (11) (FIG. 7) in such a position that they are placed permanently behind the fluorescent lamps (4). The upper part is a grid net (3) of components of different form, of the same reflecting surface with the main parabolic components (2). The grid net (3), which, on the one hand, helps the main parabolic components (2) to direct the light, while, on the other hand, is used in order to present a beautiful image with the formation of multiple reflecting levels. The multiple reflecting levels, simultaneously, manage to hide the fluorescent lamps (4) from an observer who sees the luminary from a certain optical angle. The upper part (3) of the separable grid of reflectors (2, 3) is mounted directly by the specifically shaped plastic side walls (6) by means of the proper cavities (12) (FIG. 6).

Figure 3:
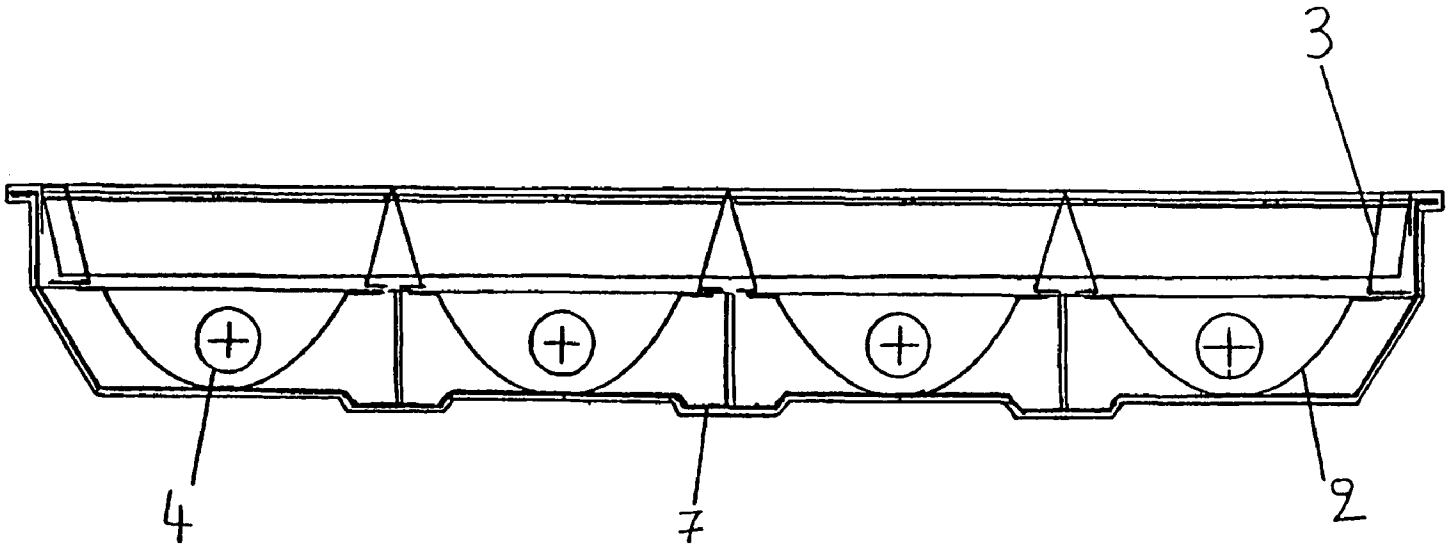
FIG. 3 is a side section of the parabolic luminary of the invention vertical to the axis of fluorescent lamps.
Figure 4:
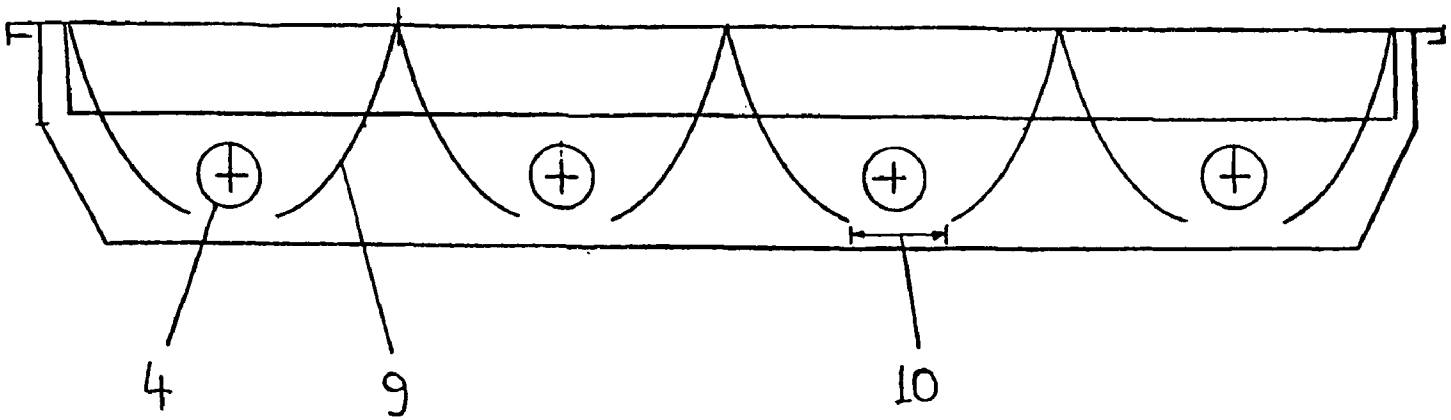
Figure 4 (PRIOR ART)
FIG. 4 is a side section of a random parabolic false ceiling luminary of the prior art, shown vertical to the axis of fluorescent lamps.
Figure 5:
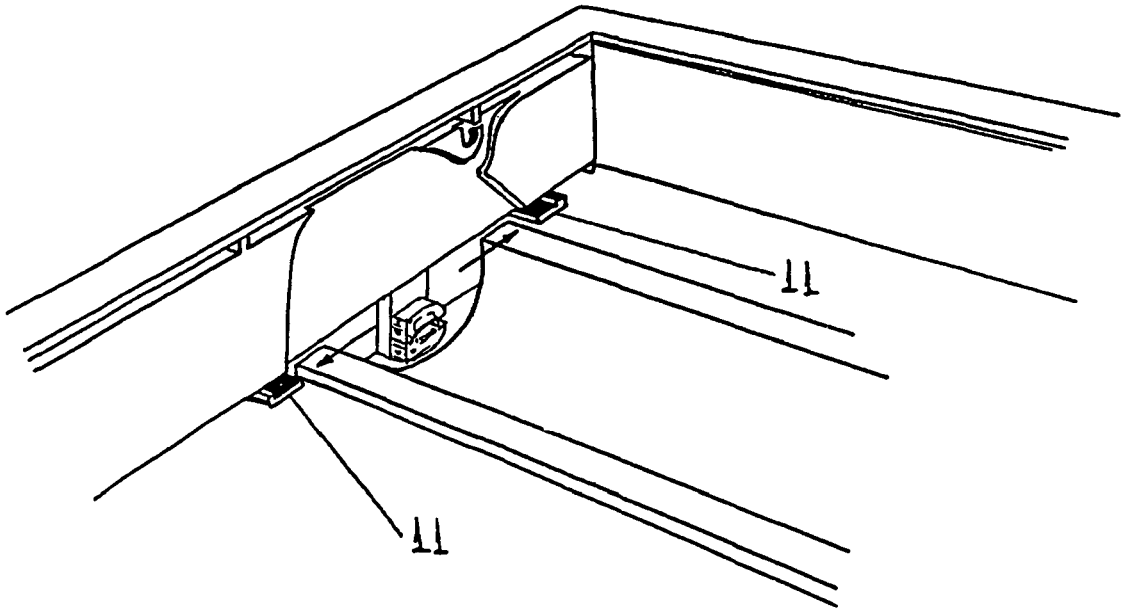
FIG. 5 is a partial side view in perspective of the specific shaping of the plastic side walls for mounting the main parabolic components of the separable grid of reflectors.

The dividing of the grid of reflectors in two parts allows the removal of the upper part (3) independently of the firmly placed main parabolic components (2) at the lower part of the luminary. In case it is necessary to replace lamps or starters in the luminary, only the upper part (3) of the divided reflectors' net (2, 3) is removed from the luminary, without effecting the main parabolic components (2). Thus, the main parabolic components (2) do not need to leave the known openings (10) (FIG. 4) all along, which, in other parabolic fluorescent luminaries for exposed and false ceiling are used in order that the unified grid of reflectors (9) (FIG. 4) passes by the obstacle of fluorescent lamps (4) when it is necessary to remove the grid from the luminaries for replacing a damaged lamp or starter. Thus, the main parabolic components (2) (e.g., FIG. 3) of the invention are continuous underneath the lamps, without openings and are shaped in the ideal parabolic form which increases enormously the luminary performance due to the appropriate direction of light.

Both parts of the divided grid of reflectors (2, 3) of the invention's luminary constitute the composition of elements of various forms, which are manufactured by thermo-mechanical shaping from a thin plastic film of at least one reflecting surface. In more detail, the shaping of the components of the divided grid of reflectors (2, 3) is achieved automatically and productively with special thermo-mechanical processing of the thin plastic film so that the shaping of even the most difficult curvy intersections of the main parabolic components (2) of the divided grid (2, 3) can be achieved. The low specific gravity of the thin plastic film in relation to the one of aluminum results in the reduction by 50% of the total weight of the divided grid of reflectors (2, 3). The low weight in combination with the plastic quality of material eliminates the risk of injury to the installer because of sharp edges, while the flexibility makes it resistant to damage from mechanical pressure upon installation. For the same aforementioned reasons, it does not provoke an accident in case it randomly falls from the ceiling.

The invention claimed is:

1. System of reflectors and base of parabolic fluorescent luminary, comprising a grid of parabolic reflectors for the concentration and focalization of light emitted by fluorescent lamps; the grid including;

a) a first part forming main parabolic components for concentrating and directing the light from fluorescent lamps; and b) a second part comprising a cross-made grid for being placed over the main parabolic components and over the fluorescent lamps;

c) the first and second parts of the grid being made of a thin plastic film through thermo mechanical blending or curving of the thin plastic film.

2. System of reflectors and base of parabolic fluorescent luminary according to claim 1, wherein the thin plastic film of at least one reflecting surface comprises a very thin membrane of approximately 0.015 mm with a surface of high reflective property mounted on a thicker layer of a material with a thickness approximately 0.10–0.40 mm.

3. System of reflectors and base of parabolic fluorescent luminary according to claim 1, wherein the second part of the grid of parabolic reflectors is separable from the luminary without removing the first part of said grid.

4. System of reflectors and base of parabolic fluorescent luminary according to claim 1, wherein the main parabolic components of the grid of parabolic reflectors provides a continuous reflecting surface without openings underneath the fluorescent lamps.

5. System of reflectors and base of parabolic fluorescent luminary according to the claim 1, wherein a support base for electrical components and for the grid of reflectors includes a bottom of iron sheet; the bottom of iron sheet having oblong ribs along the length of the fluorescent lamps for strengthening the support base and thus allowing a reduction in thickness of the bottom compared to a bottom lacking said oblong ribs.

6. System of reflectors and base of parabolic fluorescent luminary according to the claim 5, wherein the two side walls of the support base running along the length of the fluorescent lamps are made from iron sheet and are not shaped other than with bends along the length of the fluorescent lamps.

7. System of reflectors and base of parabolic fluorescent luminary according to claim 1, wherein, from beneath the luminary when installed in a ceiling, the grid of reflectors the main body fully covers the main body of a support base for electrical components, so as to avoid the need to paint the support base.

8. System of reflectors and base of parabolic fluorescent luminary according to claim 1, wherein the thin plastic film of at least one reflecting surface comprises a very thin membrane with a surface of high reflective property mounted on a thicker layer of a material with a thickness approximately 0.10–0.40 mm.

9. System of reflectors and base of parabolic fluorescent luminary, comprising:

a) a grid of parabolic reflectors made of a thin plastic film of at least one reflecting catoptrical or diffusive surface for the concentration and focalization of light emitted by fluorescent lamps; the grid including:
   i) a first part forming main parabolic components for concentrating and directing the light from fluorescent lamps; and
   ii) a second part comprising a cross-made grid for being placed over the main parabolic components and over the fluorescent lamps;

b) a support base for electrical components and for the grid of reflectors having a main body of iron sheet and two elaborated side walls at the longitudinal ends of the lamps; the elaborated side walls being the main side walls of the support base for imparting steadiness to the support base and being formed of plastic; and c) the elaborated side walls having specifically shaped cavities and projections for both assembling to the main body of iron sheet by merely snapping, without welding or riveted jointing to the main body, and mounting the first and second parts of the parabolic reflector grid without the use of springs or other supplementary hardware;

d) the support base including a bottom of iron sheet; the bottom of iron sheet having oblong ribs along the length of the fluorescent lamps for strengthening the support base and thus allowing a reduction in thickness of the bottom compared to a bottom lacking said oblong ribs.

10. System of reflectors and base of parabolic fluorescent luminary according to the claim 9, wherein the two side walls of the support base running along the length of the fluorescent lamps, made from iron sheet, are not shaped other than with bends along the length of the fluorescent lamps.

* * * * *